US005403007A

United States Patent [19]

Chen

[11] Patent Number: 5,403,007

[45] Date of Patent: * Apr. 4, 1995

[54] GOLF CLUB HEAD OF COMPOUND MATERIAL

[76] Inventor: Archer C. C. Chen, 35, Yichaong E. Road, Taipin, Taichung County, Prov. of China

[ * ] Notice: The portion of the term of this patent subsequent to Mar. 3, 2010 has been disclaimed.

[21] Appl. No.: 178,471

[22] Filed: Jan. 5, 1994

Related U.S. Application Data

[63] Continuation of Ser. No. 920,740, Jul. 28, 1992, abandoned.

[51] Int. Cl.[6] ..... A63B 53/04

[52] U.S. Cl. ..... 273/173; 273/167 J

[58] Field of Search ..... 273/173, 167 A, 167 J, 273/169, 172, 78, DIG. 33, 167 H, 167 R, 167 F, 167 D, 167 K, 170, 171, 174, 175, 77 R,77 A

[56] References Cited

U.S. PATENT DOCUMENTS

| | | | |
|---|---|---|---|
| 2,034,936 | 3/1936 | Barnhart | 273/78 |
| 3,975,023 | 8/1976 | Inamori | 273/173 |
| 4,667,963 | 5/1987 | Yoneyama | 273/169 |
| 4,749,197 | 6/1988 | Orlowski | 273/173 |
| 4,874,171 | 10/1989 | Ezaki et al. | 273/172 |
| 4,884,812 | 12/1989 | Jagasaki et al. | 273/78 |
| 5,004,242 | 4/1991 | Iwahaga | 273/167 A |
| 5,016,883 | 5/1991 | Kobayashi | 273/173 |
| 5,083,778 | 1/1992 | Douglass | 273/78 |
| 5,106,094 | 4/1992 | Desbiolles et al. | 273/173 |
| 5,198,062 | 3/1993 | Chen | 273/173 |
| 5,271,621 | 12/1993 | Lo | 273/173 |
| 5,288,070 | 2/1994 | Chen | 273/78 |

*Primary Examiner*—Vincent Millin
*Assistant Examiner*—Steven B. Wong
*Attorney, Agent, or Firm*—Browdy and Neimark

[57] ABSTRACT

A golf club head of compound material has a metal body, a ball-hitting plate, and a fastening layer. The metal body of stainless steel has a body portion with a columnar neck extending upwardly and obliquely therefrom. The neck is composed of an axial hole intended to receive therein the golf club shaft. The ball-hitting plate is made of a ceramic material or a titanium alloy or a wear-withstanding material having an appropriate hardness, and is porvided with a plurality of grooves located on the surface thereof. The fastening layer is made of a fiber bulk molding compound containing resin and is sandwiched between the ball-hitting plate and the metal body as an adhering agent.

5 Claims, 2 Drawing Sheets

GOLF CLUB HEAD OF COMPOUND MATERIAL

BACKGROUND OF THE INVENTION

This application is a continuation of application Ser. No. 07/920,740, filed Jul. 28, 1992 now abandoned.

The present invention relates to a golf club head, and more particularly to a golf club head made of compound material.

The face of a golf club head must be rigid enough to sustain a severe shock of a golf ball hit by the golf club head. A golf club head of stainless steel of the prior art is defective in design in that its surface is vulnerable to formation of hollows caused by violent contacts between the golf club head and golf balls. Such hollow formation on the surface of the golf club head can adversely affect the ball-controlling capability of the golf club. As a result, a fiber reinforced material is used in place of the stainless steel to make the golf club head. Such improved golf club head has a rigidity greater than that of the golf dub head of stainless steel; nevertheless it is less capable of withstanding wear and tear.

SUMMARY OF THE INVENTION

It is, therefore, the primary objective of the present invention to provide a golf club head, which is made of compound material and furnished with a rigid hitting surface of ceramic material or titanium or other rigid material capable of withstanding wear and tear.

In keeping with the principles of the present invention, the foregoing primary objective of the present invention is accomplished by a golf club head provided with a ball-hitting plate, which is prefabricated from such rigid and wear-withstanding material as ceramic material or titanium or the other. The ball-hitting plate is provided with a plurality of grooves and is fastened securely to the ball-hitting area of the golf club head.

The present invention is characterized in that it does not make use of the prior art method of fastening the ball-hitting plate to the golf club head by means of an adhesive or of fitting the ball-hitting plate into the golf club head, and that it makes use of a fiber bulk molding compound as a means of binding the ball-hitting plate and the golf club head together, so as to overcome the technical deficiencies of the prior art method and to improve the quality of the golf club head. The fiber bulk molding compound can be made, under heat and pressure, to hold the ball-hitting plate and the metal head of the golf club together securely by filling in completely the gap between the metal head and the ball-hitting plate. In addition, the fiber bulk molding compound has an excellent rigidity to bear up against the shock.

DETAILED DESCRIPTION OF THE PREFERRED EMBODIMENTS

Figure 1:
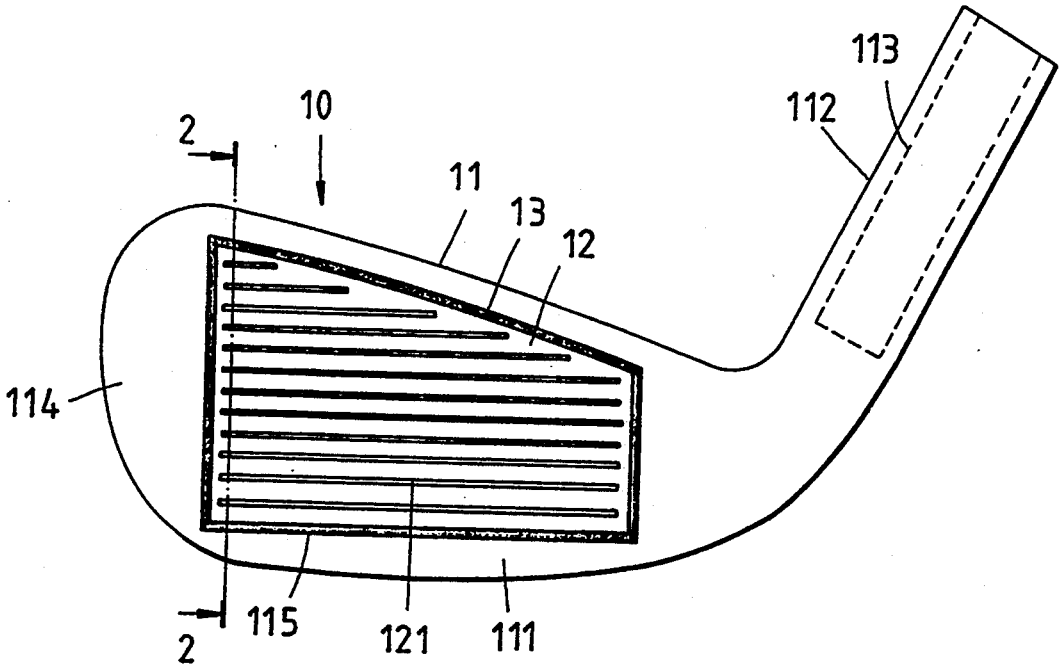
FIG. 1 shows a front view of a first preferred embodiment of the present invention.
Figure 2:
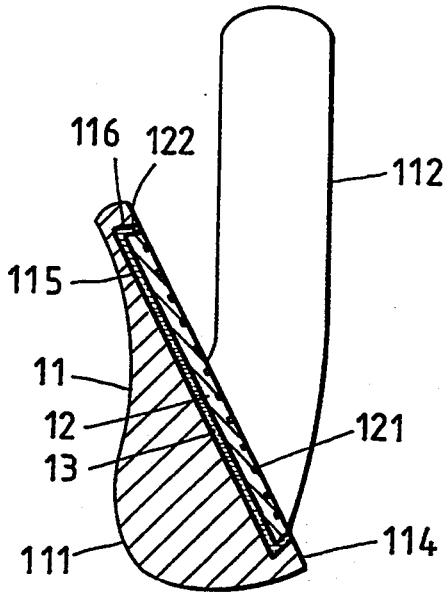
FIG. 2 shows a sectional view of a portion taken along the line 2—2 as shown in FIG. 1.

Referring to FIGS. 1 and 2, an iron head 10 of the first preferred embodiment of the present invention is shown to comprise a metal body 11, a ball-hitting plate 12, and a fastening layer 13 of compound material.

The metal body 11 of stainless steel has a body portion 111 with a neck 112 of columnar construction extending upwardly and obliquely therefrom. The neck 112 is composed of an axial hole 113 intended to accommodate therein a golf club shaft. The shape of the metal body 11 is more or less consistent with that of the iron head 10. The body portion 111 of the metal body 11 has an inclined surface 114 provided at the center thereof with a slot or recess having a metal back wall extending thereacross 115.

The ball-hitting plate 12 is made of ceramic material or titanium or any other rigid material capable of withstanding wear and tear, and is provided on the surface thereof with a plurality of grooves 121. The ball-hitting plate 12 is mounted in the slot 115 against the back wall with a fastening layer 13 therebetween.

The fastening layer 13 is made of a fiber bulk molding compound containing epoxy resin; it is filled in the slot 115 against the back wall before the ball-hitting plate 12 is lodged in the slot 115. Under heat and pressure, the fiber bulk molding compound is made to fill in completely the gap between the back wall of the metal body 11 and the ball-hitting plate 12. As a result, the cured fiber bulk molding compound holds the ball-hitting plate 12 and the metal body 11 together securely.

The advantages of the first preferred embodiment of the present invention described above are explained explicitly hereinafter.

The metal body 11 is made of the wear-resisting stainless steel and is therefore porvided with a uniformly-distributed weight, thereby resulting in a sweet spot that has been substantially enlarged.

The ball-hitting plate 12 is immune from distortion by virtue of the fact that it is made of ceramic material or titanium or any other rigid material, which has a rigidity superior to that of stainless steel or fiber reinforced compound material.

The fastening layer 13 binding securely the ball-hitting plate 12 and the metal body 11 is made of a fiber bulk molding compound having a relatively low mobility which makes it less likely to be lost during the molding porcess under heat and pressure. The fiber bulk molding compound is filled in the slot 115 of the metal body 11 before the ball-hitting plate 12 is lodged in the slot 115. The metal body 11 containing the ball-hitting plate 12 is placed in a molding tool, which is then subjected to heat and pressure so as to cause the fiber bulk molding compound to fill in thoroughly the gap between the ball-hitting plate 12 and the slot 115 of the metal body 11. As a result, the cured bulk molding compound holds securely the ball-hitting plate 12 and the metal body 11.

The wall surface 116 of the slot 115 and the wall surface 122 of the ball-hitting plate 12 can be of bevel construction, as shown in FIG. 2, which can bring about a wedge-shaped fastening layer 13 having an excellent binding capability.

Figure 3:
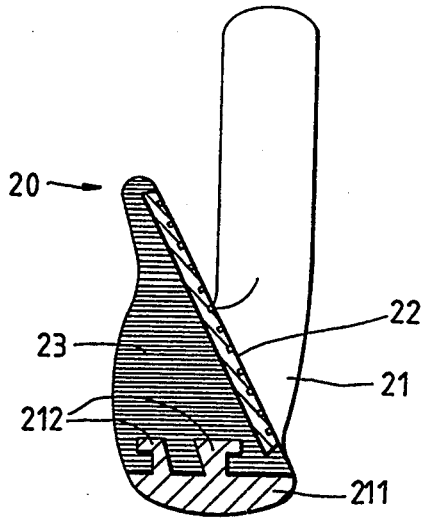
FIG. 3 shows a sectional view of a second preferred embodiment of the present invention.

Now referring to FIG. 3, an iron head 20 of the second preferred embodiment of the present invention is shown comprising a metal body 21, a ball-hitting plate 22, and a fastening layer 23 of fiber bulk molding compound. The second preferred embodiment is different from the first preferred embodiment in that the body portion 211 of the metal body 21 is of flat construction extending horizontally and is located at the bottom of the iron head 20. The body portion 211 comprises a predetermined number of binding ribs 212 located along the direction of longitudinal axis at upper portion thereof. In addition, the fastening layer 23 is located over the body portion 211.

Like the first preferred embodiment of the present invention, the second preferred embodiment of the present invention makes use of the bulk molding compound to form the fastening layer 23 binding the metal body 21 and the ball-hitting plate 22. However, in the second preferred embodiment, the bulk molding compound is used to form the main body of the club head, which has a bottom portion made of stainless steel. The specific gravity of the bulk molding compound is on the order of 1.5 g/cm$^3$, as compared with the specific gravity of 8 g/cm$^3$ of the stainless steel. As a result, the club head can be made in various forms allowing the position of the center of gravity to be adjusted.

Figure 4:
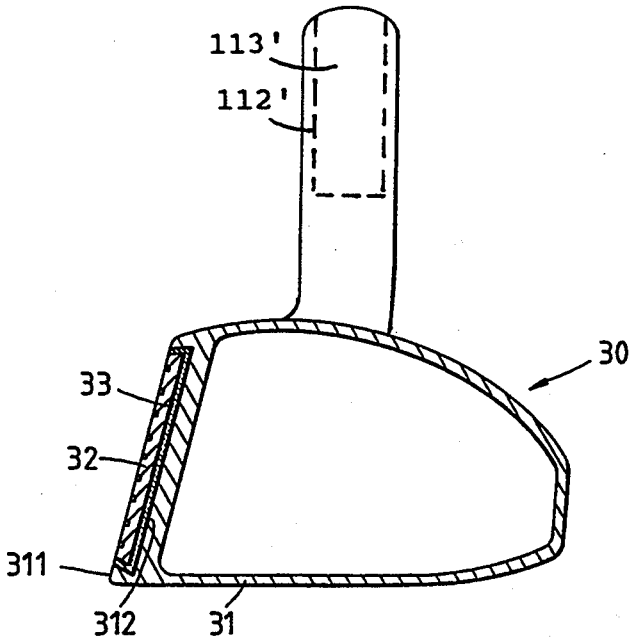
FIG. 4 shows a sectional view of a third preferred embodiment of the present invention.

As shown in FIG. 4, a wooden head 30 of the third preferred embodiment of the present invention comprises a metal body 31, a nicked portion 112', an axial hole 113', a ball-hitting plate 32, and a fastening layer 33. The difference between the first and the third preferred embodiments of the present invention is that the latter has a metal body 31 shaped like a wooden club head and provided with a slot 312 located at the center of a surface 311 of the metal body 31. The slot 312 is intended to accommodate the fastening layer 33.

Figure 5:
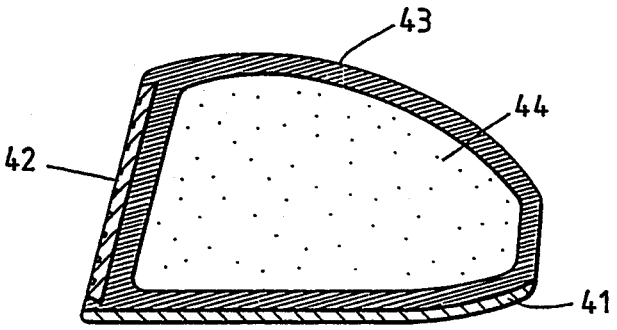
FIG. 5 shows a sectional view of a fourth preferred embodiment of the present invention.

A wooden head 40 of the fourth preferred embodiment of the present invention, as shown in FIG. 5, comprises a metal body 41, a ball-hitting plate 42, and a fastening layer 43. The wear-withstanding metal body 41 is located at the bottom of the head. The fastening layer 43 is formed as the main body of the head and provided with a foamed body 44 of polyurethane, so as to reduce the amount of fiber resin that is used. Such head is light in weight and can be made in various forms to facilitate a change in the position of the center of gravity of the head.

What is claimed is:

1. A golf club head of compound material, comprising:

a metal body having a hollow main body of a wood head shape, said main body having a neck portion extending outwards and obliquely from one side thereof, said neck portion having an axial hole for fastening a golf club, said main body having a recess corresponding in location to a striking surface, said recess having a back wall of metal extending thereacross;

an adhesive reinforcing layer of a bulk molding compound of fibers preimpregnated with resins which is disposed in said recess and then cured under heat and pressure against said back wall; and a ball-hitting plate of rigid material and having a surface provided thereon with a plurality of grooves, said ball-hitting plate being placed on said bulk molding compound and adhered to said adhesive reinforcing layer upon the completion of he curing of said bulk molding compound, so as to cover an opening side of said recess and said adhesive reinforcing layer in order to form said striking surface said back wall constituting a support for said adhesive reinforcing layer and said ball-hitting plate along substantially their entire extent.

2. A golf club head according to claim 1 said ball-hitting plate is metal.

3. A golf club head according to claim 1 said ball-hitting plate is ceramic.

4. A golf club head according to claim 1 said ball-hitting plate is abrasionresistant material.

5. A golf club head for a golf club, comprising:

a main body portion formed of metal and having a face corresponding in area and location to a golf ball-striking surface of said golf club head, said face having a recess therein with a metal back wall extending substantially entirely thereacross;

a reinforcing layer of cured bulk molding compound comprised of fibers preimpregnated with resin disposed within said recess against said metal back wall in a generally planar layer form with said metal back wall constituting a support along substantially its entire extent for said reinforcing layer, said cured bulk molding compound constituting means for improving the rigidity of said golf club head to bear up against shock; and a ball-hitting plate of rigid material having a facing surface comprising a plurality of grooves, said ball-hitting plate being adhesively secured at least partly within said recess against said back wall and adhesively held by said reinforcing layer of cured bulk molding compound.

* * * * *